US005789906A

United States Patent [19]

Mizuide

[11] Patent Number: 5,789,906

[45] Date of Patent: Aug. 4, 1998

[54] REFERENCE VOLTAGE GENERATING CIRCUIT AND METHOD

[75] Inventor: Yasuo Mizuide, Kawasaki, Japan

[73] Assignee: Kabushiki Kaisha Toshiba, Kawasaki, Japan

[21] Appl. No.: 835,513

[22] Filed: Apr. 8, 1997

[30] Foreign Application Priority Data

Apr. 10, 1996 [JP] Japan ..... 8-086978
Apr. 1, 1997 [JP] Japan ..... 9-082732

[51] Int. Cl.[6] ..... G05F 3/16

[52] U.S. Cl. ..... 323/313

[58] Field of Search ..... 323/313, 314, 323/316, 907

[56] References Cited

U.S. PATENT DOCUMENTS

| | | | |
|---|---|---|---|
| 5,229,710 | 7/1993 | Kraus et al. | 323/313 |
| 5,229,711 | 7/1993 | Inoue | 323/313 |
| 5,352,973 | 10/1994 | Audy | 323/313 |
| 5,568,045 | 10/1996 | Koazechi | 323/314 |
| 5,610,506 | 3/1997 | McIntrye | 323/313 |

FOREIGN PATENT DOCUMENTS 7-306728 11/1995 Japan .

OTHER PUBLICATIONS

IEEE Journal of Solid-State Circuits, vol. SC-9, No. 6, pp. 388-393, Dec. 1974, A. Paul Brokaw, "A Simple Three-Terminal IC Bandgap Reference".

*Primary Examiner*—Stuart N. Hecker
*Attorney, Agent, or Firm*—Oblon, Spivak, McClelland, Maier & Neustadt, P.C.

[57] ABSTRACT

A reference voltage generating circuit generates a predetermined reference voltage being independent of the dispersion of manufacturing lots. The base and the collector of a transistor is connected to a first input terminal of an operational amplifier. A resistor is connected between a second input terminal and an output terminal of the operational amplifier. The output terminal outputs the reference voltage. A voltage independent of the current amplification factor of the transistor is supplied to the input terminal of the operational amplifier via the transistor. And, a current independent of the reference voltage is supplied to the second input terminal of the operational amplifier. Here, a current proportional to the current amplification factor of the transistor is supplied to the base and the collector of the transistor.

11 Claims, 4 Drawing Sheets

REFERENCE VOLTAGE GENERATING CIRCUIT AND METHOD

BACKGROUND OF THE INVENTION

1. Field of the Invention

The present invention relates to a semiconductor integrated circuit, and more specifically to a reference voltage generating circuit and a reference voltage generating method.

2. Description of the Prior Art

A conventional reference voltage generating circuit will be explained hereinbelow with reference to FIG. 1. In FIG. 1, the conventional circuit consists of a widlar current mirror circuit 500 including two transistors Q1 and Q2 and a resistor R2; two resistors R1 and R3 connected to two nodes N1 and N3, respectively; a current source I for supplying a current to these resistors R1 and R3, respectively; and an operational amplifier (OP amp) having two input terminals connected to the two nodes N1 and N3, respectively and an output terminal VBG for outputting a reference voltage. Further, the output terminal VBG is feedbacked to a node N2.

In general the emitter area of the transistor Q2 is designed to be an integer times (e.g., four times) larger than that of the transistor Q1. This can be also attained by determining the resistance value of the resistor R1 to be integer times larger than that of the resistor R2, without increasing the emitter area of the transistor Q2. Here, this multiplying factor is determined as being 2, 8, 16, . . . in the circuit specification, which is a numeral N larger than one.

The operation of the above-mentioned circuit will be explained hereinbelow. The current supplied by the constant current source I is divided into I1 and I3. Further, the remaining current thereof is absorbed by the OP amp 600. When the OP amp 600 is activated, the current I3 is supplied to the widlar current mirror circuit 500, and the current I1 controlled by the widlar current mirror circuit 500 flows through the resistor R1. Therefore, a potential difference R1×I1 can be generated across the resistor R1.

Further, a potential V3 at the node N3 is biased to a potential VBE1 generated between the base and emitter of the transistor Q1. Here, the OP amp 600 absorbs a residual current obtained by subtracting an addition of the currents I1 and I3 from the current source I. The voltages V1 and V3 are thus equal to each other, so that the potential V1 is equal to VBE1. Therefore, the reference voltage VBG and the base-emitter voltage VBE1 can be given by the following formulae:

$$VBG=I1\times R1+VBE1 \quad (1)$$

$$VBE1=KT/q\times ln(I3/Is) \quad (2)$$

where K denotes the Boltzmann's constant; T denotes the temperature; q denotes the charge; Is denotes the saturated emitter current proportional to the emitter area and the current amplification factor hFE thereof. Here, since the temperature coefficient of the base-emitter voltage VBE1 (i.e., the second term on the right side of the above formula (1) is about−2 mV/°C., the three resistance values R1, R2 and R3 are so determined that the temperature coefficient of I1×R1 (i.e., the first term on the right side of the same formula (1)) becomes+2 mV/°C. Under these condition, it is possible to obtain a reference voltage generating circuit which can generate a roughly constant reference voltage not dependent upon change in the ambient temperature. Further, in general this reference voltage is kept at about 1.25V, which is referred to as a band gap voltage VBG.

In the conventional reference voltage generating circuit as described above, when the current amplification factor hFE of the transistor disperses due to the difference in manufacturing lots, the change in the current amplification factor hFE due to the dispersion of the manufacturing lots exerts influence upon the second term of the formula (1); that is, the reference voltage VBG of the formula (1). Because the saturated emitter current Is included on the right side of the formula (2) is proportional to this current amplification factor hFE.

On the other hand, since the current I3 flowing through the transistor Q1 can be given by the following formula (3):

$$I3=(VBG-VBE1)/R3 \quad (3)$$

This indicates that the input current I3 of the widlar current mirror circuit 500 is susceptible to change in the base-emitter voltage VBE1; that is, the current amplification factor hFE. As a result, the output current I1 of the widlar current mirror circuit 500 is susceptible to change in the current amplification factor hFE.

Further, FIG. 2 shows the dependence of the reference voltage VBG upon temperature. FIG. 2 indicates that since the reference voltage is compensated for temperature, the dependence of the reference voltage VBG upon temperature is reactively small, however, the reference voltage VBG is still dependent upon the current amplification factor hFE.

As described above, when the reference voltage generating circuit is formed on an integrated circuit, there exists a problem in that the dispersion of the current amplification factor hFE caused by difference between the manufacturing lots exerts a harmful influence upon the reference voltage VBG of the circuit.

SUMMARY OF THE INVENTION

With these problems in mind, it is the object of the present invention to provide a reference voltage generating circuit and a method of manufacturing the same circuit, which can generate a stable reference voltage without being subjected to the influence of difference between the manufacturing lots.

To achieve the above-mentioned object, the present invention provides a reference voltage generating circuit, comprising: an operational amplifier having a first input terminal, a second input terminal, and an output terminal for outputting a reference voltage; voltage supplying means having at least one first transistor, for supplying a voltage independent of a current amplification factor of the first transistor to the first input terminal of the operational amplifier via the first transistor; a resistor connected between the second input terminal and the output terminal of the operational amplifier; and first current supplying means for supplying a first predetermined current independent of the reference voltage to the second input terminal of the operational amplifier via the resistor.

Further, the present invention provides a compactor circuit, comprising: an operational amplifier having a first input terminal, a second input terminal, and an output terminal for outputting a reference signal having a reference voltage; voltage supplying means having at least one transistor, for supplying a voltage independent of a current amplification factor of the transistor to the first input terminal of the operational amplifier via the transistor; a resistor connected between the second input terminal and the output terminal of the operational amplifier; current supplying means for supplying a predetermined current independent of the reference voltage to the second input terminal of the operational amplifier via the resistor; and a comparator for comparing an input signal with the reference signal in voltage level to output an output signal corresponding to a comparison result between the input signal and the reference signal.

Further, the present invention provides a method of generating a reference voltage by use of a circuit having an operational amplifier, a transistor having a base and a collector both connected to a first input terminal of the operation amplifier and an emitter connected to ground, and a resistor connected between a second input terminal and an output terminal of the operational amplifier, the method comprising the steps of: supplying a voltage independent of a current amplification factor of the transistor to the first input terminal of the operational amplifier via the transistor; and supplying a first predetermined current independent of the reference voltage to the second input terminal of the operational amplifier via the resistor.

DETAILED DESCRIPTION OF THE PREFERRED EMBODIMENTS

Figure 3:
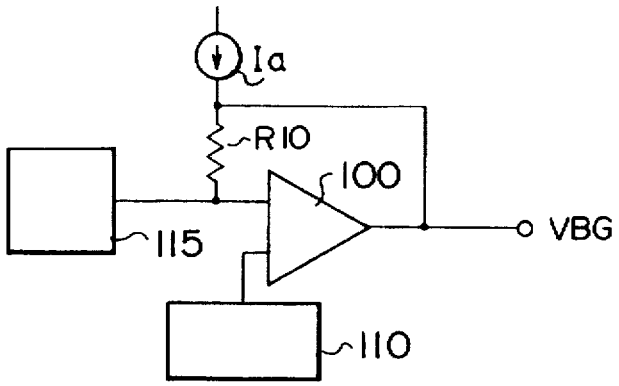
FIG. 3 is a conceptual circuit diagram showing an embodiment of the reference voltage generating circuit according to the present invention.

An embodiment of the reference voltage generating circuit according to the present invention will be described in detail hereinbelow with reference to the attached drawings. FIG. 3 is a conceptual circuit diagram showing the circuit according to the present invention. In FIG. 3, the reference voltage generating circuit consists of an operational amplifier (OP amp) 100; a resistor R10 connected between an output terminal and one input terminal of the OP amp; a voltage supplier 110 including at least one transistor Q40 (shown in FIG. 4) connected to the other input terminal of the OP amp 100, for generating a base-emitter voltage (VBE40 shown in FIG. 4) not subjected to the current amplification factor of the transistor Q40; current supplying means 115 for controlling the current flowing through the resistor R10; and a constant current source Ia connected to a junction node between the resistor R10 and the output terminal of the OP amp 100.

Figure 4:
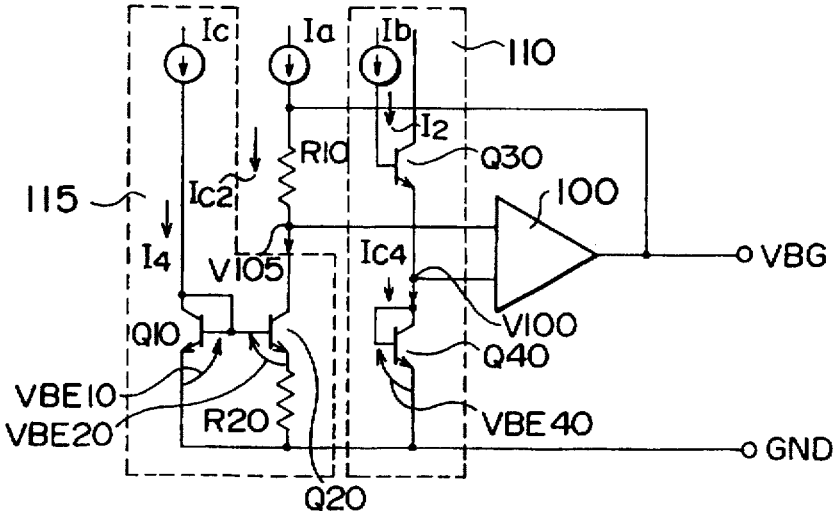
FIG. 4 is a circuit diagram showing a practical circuit construction of the same embodiment shown in FIG. 3.

FIG. 4 is a more practical circuit diagram showing the same reference voltage generating circuit shown in FIG. 3. In FIG. 4, the voltage supplier 110 includes a constant current source Ib and two transistors Q30 and Q40 both having the same characteristics with respect to each other. Further, the current supplier 115 is a widlar current mirror circuit of two transistors Q10 and Q20 and a resistor R20, and a current source Ic connected to both the transistors Q10 and Q20.

The operation of the reference voltage generating circuit shown in FIG. 4 will be described hereinbelow. In the voltage supplier 110, a small current I2 supplied by the current source Ib is amplified on the basis of the current amplification factor hFE3 of the transistor Q30. The amplified small current I2 is supplied to the transistor Q40 as a collector current IC4 expressed as follows:

$$IC4=hFE3\times I2 \tag{4}$$

Further, the base-emitter voltage VBE40 of the transistor Q40 can be given by the following formula:

$$VBE40=KT/q\times In(IC4/IS40) \tag{5}$$

Further, as already explained, the saturated current IS40 is proportional to the current amplification factor hFE4 of the transistor Q40. However, in the case of the integrated circuit, it is possible to eliminate the dependency of the term of the IC4/IS40 in the formula (5) upon the current amplification factor hFE. Because the pair precision of the two transistors Q30 and Q40 in the integrated circuit is high and thereby the-current amplification factors hFE of both the transistors Q30 and Q40 are roughly equal to each other. Here, there exists a big difference between the circuit of the present invention shown in FIG. 4 and the conventional circuit (shown in FIG. 1) in the method of generating the current IC2 of the circuit of the invention and the current I1 of the conventional circuit.

In more detail, in the case of the circuit according to the present invention, it is possible to stabilize the voltage VBE40 in relation to the current amplification factor hFE by allowing the current IC4 to be proportional to the current amplification factor hFE. Because the IS40 of the term (IC4/IS40) of the formula (5) is proportional to the current amplification factor hFE.

In the general IC manufacturing process, the dispersion of the current amplification factor hFE is as large as about 300% (or 200 to 500%); on the other hand, the dispersion of the resistance is about ±10 to 20%. That is, the dispersion width of the current amplification factor hFE is much larger than that of the resistance.

Therefore, when the current for deciding the base-emitter voltage is controlled by the resistance, it is possible to obtain the characteristics of lesser dispersion, with the result that the voltage V100 applied to the one of the input terminals of the OP amp 100 is not dependent upon change in the current amplification factor hFE of the transistor Q40. As described above, the voltage supplier 110 of the present invention can generate a voltage not dependent upon the current amplification factor hFE of the transistor Q40.

Successively, in the current supplier 115, when current I4 flows from the current source Ic to the widlar current mirror circuit 115 of the two transistors Q10 and Q20 and the resistor R20, the output current IC2 can be decided in accordance with the following formula (6)

$$KT/q\times In(I4/IS4)=KT/q\times In(IC2/ISC2)+IC2\times R2 \tag{6}$$

where IS4 and ISC2 are saturated currents of the two transistors Q10 and Q20, respectively.

Figure 1:
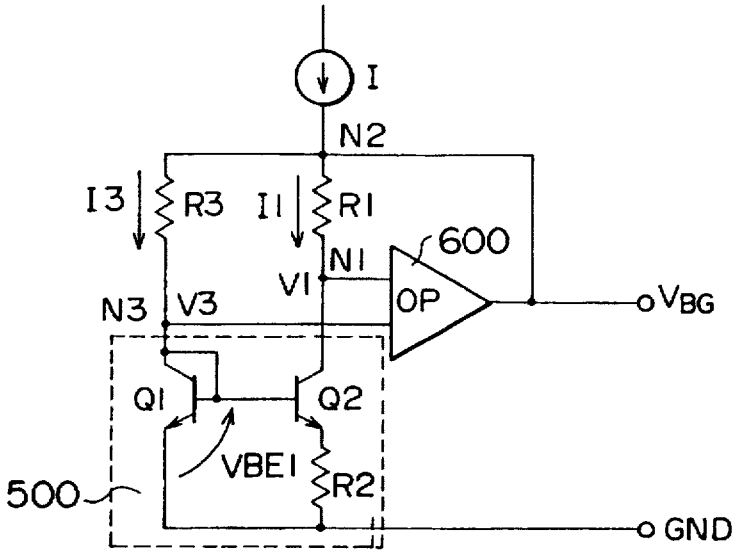
FIG. 1 PRIOR ART
FIG. 1 is a circuit diagram showing a conventional reference voltage generating circuit.
Figure 2:
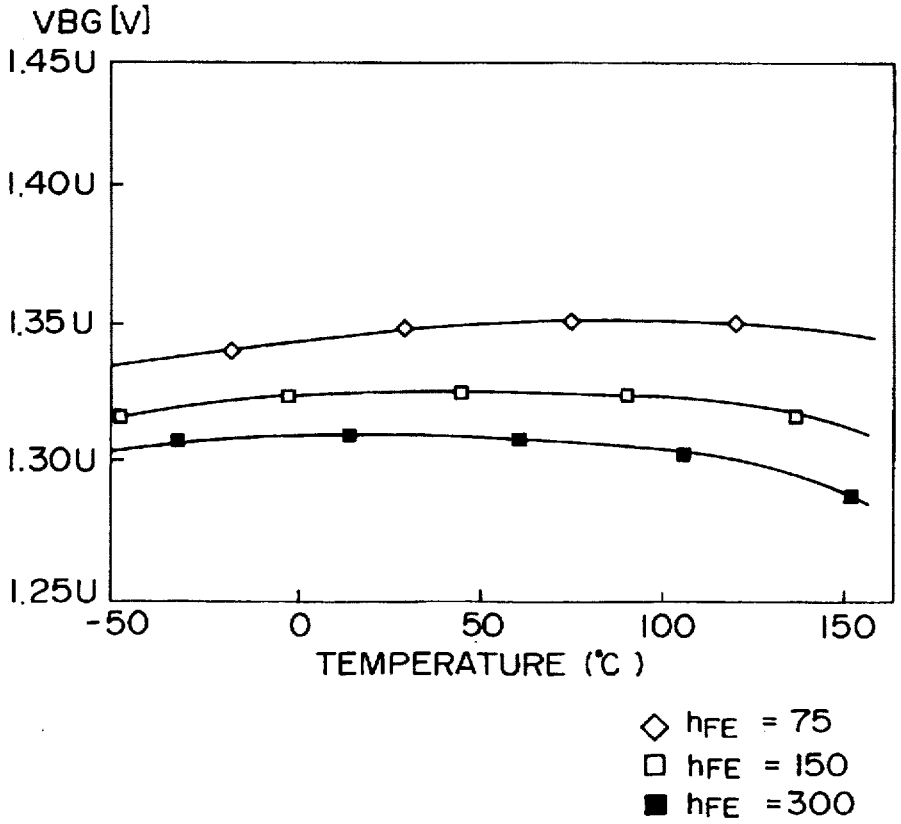
FIG. 2 is a graphical representation showing the characteristics between the outputted reference voltage and temperature of the conventional reference voltage generating circuit shown in FIG. 1, in which the current amplification factor hFE is used as a parameter.

By the way, in the case of the conventional circuit shown in FIG. 1, the output current I3 of the transistor Q1 is susceptible to the emitter-base voltage VBE1 which is also dependent upon the current amplification factor hFE. Because the output current I3 of the transistor Q1 is decided by the term (VBG−VBE1) of the formula (3). Further, in the same way as with the case of the formula (3), the output current I1 of the transistor Q2 can be expressed as $$I1=(VBG-VBE1)/R1 \quad (7)$$

Therefore, the current I1 is also susceptible to change in the emitter-base voltage VBE1.

In contrast with this, in the case of the circuit according to the present invention, the output current IC2 (which corresponds to the output current I1 of the conventional circuit) can be obtained as $$IC1=(VBE10-VBE20)/R20 \quad (8)$$

Therefore, on the basis of the formula (2), the two base-emitter voltages of the two transistors Q10 and Q20 can be obtained as follows:

$$VBE10=kt/q*Ln(I4/IS4)$$

$$VBE20=kt/q*Ln(IC2/ISC2)$$

where IS4 and ISC2 are saturated emitter currents of the two transistors Q10 and Q20, respectively.

That is, since a difference between the two is as follows:

$$VBE10-VBE20=kT/q*Ln(I4/IS4)/(IC2/ISC2) \quad (9)$$

as far as the current ratio of the logarithmic term can be replaced with a constant N, it is possible to express the characteristics proportional to the absolute temperature T. In this connection, in the case of the conventional circuit, the reference voltage VBG to be regularized with respect to temperature is included in the formula (7) for obtaining the output current I1. It is thus impossible to allow the circuit to follow the change in the base-emitter voltage VBE which is dependent upon the current amplification factor hFE in addition to temperature.

In the case of the present invention, in order to obtain the characteristics dependent upon only temperature, the current source Ic not related to the reference voltage VBG is constructed by use of a widlar current mirror circuit (not shown).

That is, the currents I4 and IC2 are decided on the basis of a difference in the base-emitter voltage VBE between the two in such a way that the following relationship can be obtained:

$$(I4/IS4)/(IC2/ISC2)=N$$

Here, since the current IC2 can be expressed by the formula (8), the current I4 is generated by the widlar current mirror circuit (not shown) in such a way that the following relationship can be obtained:

$$I4=(VBEx-VBEy)/Rz \quad (10)$$

Here, when the formulae (8) and (10) are substituted for the logarithmic term of the formula (9), $$(VBEx-VBEy)/(Rz/IS4)/(VBE10-VBE20)/(R20/ISC2)$$

When further transformed, $$(VBEx-VBEy)/(VBE10-VBE20)\times R20/Rz\times ISC2/IS4 \quad (11)$$

Therefore, it is possible to obtain, a product of a ratio of the differences in the base-emitter voltage between both I4 and IC2, a ratio of the resistances of both, and a ratio of the saturated emitter currents of both. In the case of the integrated circuit, these ratios can be obtained precisely as the ratios of the element characteristics of the same sorts, both in the same manufacturing lot and between the different manufacturing lots. Because the elements can be manufactured on the same silicon substrate in accordance with the same patterning process. As a result, it is possible to stabilize the product of these ratios as a constant N, so that the logarithmic term of the formula (9) can be obtained as a stable constant between the manufacturing lots.

In contrast with this, in the case of the conventional circuit, as expressed by the formula (7), the constant reference voltage VBG affects the current I1 and thereby the dispersion of the current amplification factor of the transistors between the manufacturing lots is reflected upon the dispersion of the base-emitter voltage as the saturated emitter current. The value corresponding to the voltage ratio as expressed by the formula (11) thus causes the dispersion of the characteristics between the manufacturing lots.

As described above, when the formula (6) is transformed, the following formula can be obtained $$IC2=kT/q*Ln(N)$$

This current IC2 flows through the resistor R10 as the collector current of the transistor Q20, so that a voltage $$IC2*R10=R10/R20*kT/q*Ln(N)$$

can be generated. This indicates that the voltage is dependent upon the constant N and the resistance ratio, other than the temperature term, so that a stable term proportional to temperature can be obtained.

Further, the current I4 is generated by a current source circuit having an excellent low current characteristics and a high output impedance, in such a way that the change in the dependency of the base-emitter voltage VBE1 upon the current amplification factor hFE does not exert the change in the current I4; that is, that the current I4 is not influenced by the base-emitter voltage of the load transistor Q10 (without setting the current I1 by use of the resistor R1 shown in FIG. 1).

As a result, the reference voltage VBG can be obtained by the following formula:

$$VBG=VBE40+R10\times IC2 \quad (12)$$

As described above, the VBE40 of the transistor Q40 is not dependent upon the current amplification factor hFE of the transistor Q40. Further the current IC4 is not influenced by the base-emitter voltage VBE10 of the transistor Q10. The current IC2 is thus not dependent upon the current amplification factors hFE of the transistors. Therefore, it is possible to reduce the dependency of the output voltage VBG as expressed by the formula (12) upon temperature and the current amplification factors of the transistors.

Figure 5:
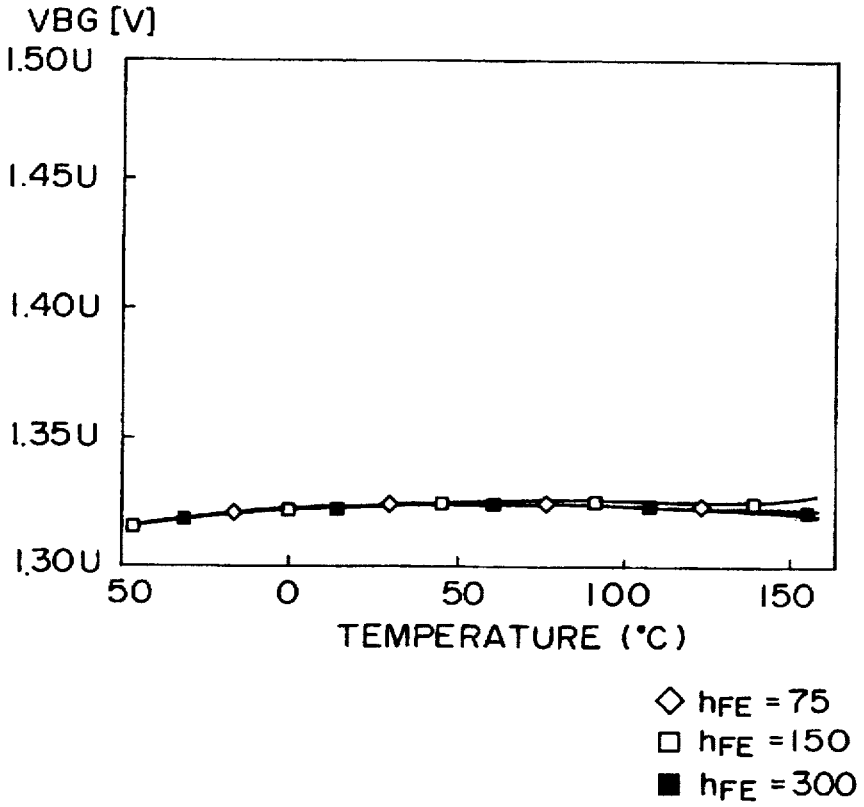
FIG. 5 is a graphical representation showing the characteristics between the outputted reference voltage and temperature in the embodiment of the reference voltage generating circuit shown in FIG. 4, in which the current amplification factor hFE is used as a parameter.

Further, FIG. 5 shows the dependency of the output voltage VBG upon temperature by use of the current amplification factor of the transistor Q40 as a parameter, in which R10 is 2kΩ and R20 is 30kΩ. FIG. 5 indicates that the output voltage VBG is a roughly constant voltage, without being depending upon the temperature and the current amplification factor.

Figure 6:
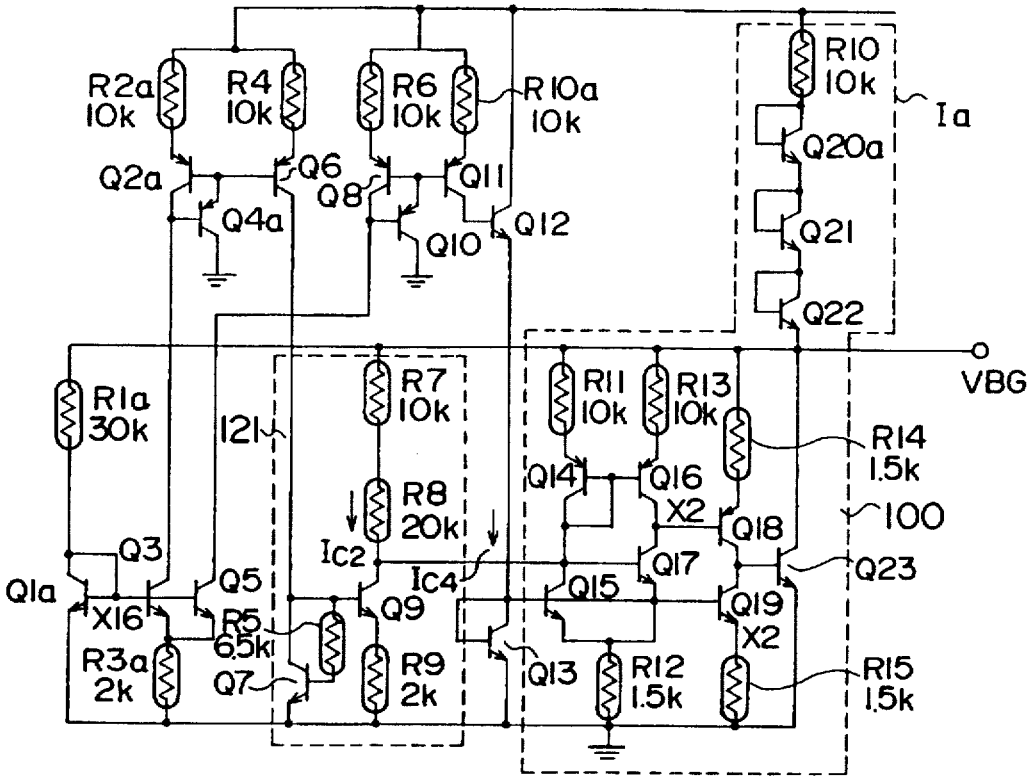
FIG. 6 is a more detailed circuit diagram showing the reference voltage generating circuit shown in FIG. 4.

FIG. 6 shows a more detailed practical circuit of the reference voltage generating circuit shown in FIG. 4, in which a reference voltage VBG of 1.25V can be obtained on the basis of a supply voltage of 5V.

The current source la shown in FIG. 4 consists of a resistor R16, and three transistors Q2O*a*, Q21 and Q22. Further, a transistor Q13 is a diode-connected transistor for generating the reference voltage VBG, which is biased by an emitter current of a transistor Q12. Further, a block 121 that consists of two transistors Q7 and Q9 and three resistors R7, R8 and R9, generates the voltage expressed by a term proportional to temperature in the formula (6).

Further, three widlar current mirror circuits are connected in FIG. 6, as the current sources Ib and Ic. The first widlar current mirror circuit consists of two resistors R1*a* and R3*a* and two transistors Q1*a* and Q3. The second widlar current mirror circuit consists of two resistors R2*a* and R4 and three transistors Q2*a*, Q4*a* and Q6. And the third widlar current mirror circuit consists of two resistors R6 and R10*a* and three transistors Q8, Q10 and Q11. The current I4 supplied by the current source Ic shown in FIG. 4 is given from the second widlar current mirror circuit to the transistor Q7. Further, the current I2 supplied by the current source Ib shown in FIG. 4 is given from the third widlar current mirror circuit as the base current of the transistor Q12.

The reference voltage generating circuit according to the present invention as shown in FIG. 6 is of two-stage cascade connection. It is thus possible to reduce the influence of the reference voltage VBG given to the resistor R1*a* upon the output current of the transistor Q3.

As described above, in the circuit shown in FIG. 4, the reference voltage VBG is given as an addition of the base-emitter voltage VBE40 of the transistor Q40 and a voltage drop across the resistor R10. Here, the current supplier 115 for controlling the current IC2 flowing through the resistor R10 is not influenced by the dispersion of the current amplification factors hFE. Further, the base-emitter voltage VBE40 of the transistor Q40 is not dependent upon its current amplification factor. Therefore, in the reference voltage generating circuit according to the present invention, it is possible to generate a stable reference voltage without depending upon the current amplification factor of the transistors.

Figure 7:
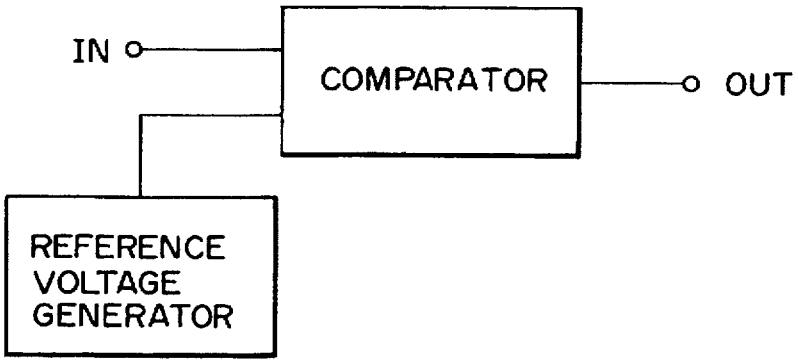
FIG. 7 is a block diagram showing a comparator circuit, to which the reference voltage generating circuit according to the present invention is applied.

Further, FIG. 7 shows a comparator circuit by way of example, to which the reference voltage generating circuit according to the present invention is applied. In this comparator circuit, an input signal applied to one input terminal of the comparator circuit is compared with a reference voltage signal generated by the reference voltage generating circuit according to the present invention and applied to the other input terminal thereof, in order to output a comparison signal between the input signal and the reference voltage signal.

As described above, in the reference voltage generating circuit according to the present invention, it is possible to generate the reference voltage VBE not susceptible to change in the current amplification factors of the transistors.

What is claimed is:

1. A reference voltage generating circuit, comprising:

an operational amplifier having a first input terminal, a second input terminal, and an output terminal for outputting a reference voltage;

voltage supplying means having at least one first transistor, for supplying a voltage independent of a current amplification factor of the first transistor to the first input terminal of the operational amplifier via the first transistor;

a resistor connected between the second input terminal and the output terminal of the operational amplifier; and first current supplying means for supplying a first predetermined current independent of the reference voltage to the second input terminal of the operational amplifier via the resistor.

2. The reference voltage generating circuit of claim 1, wherein an emitter of the first transistor is connected to ground, and a base and a collector thereof are connected in common to the first input terminal of the operational amplifier.

3. The reference voltage generating circuit of claim 2, wherein the voltage supplying means further comprises second current supplying means for supplying a current proportional to a current amplification factor of the first transistor to the base and the collector of the first transistor.

4. The reference voltage generating circuit of claim 3, wherein the second current supplying means includes a second transistor having a current amplification factor roughly equal to a current amplification factor of the first transistor and an emitter connected to the collector of the first transistor, thus the second current supplying means supplying the current proportional to the current amplification factor of the first transistor to the base and the collector of the first transistor via the second transistor.

5. The reference voltage generating circuit of claim 1, wherein the first current supplying means comprises a current mirror circuit connected to the resistor, the current mirror circuit being activated, when supplied with a second predetermined current, in such a way that the current supplied to the second input terminal of the operational amplifier via the resistor is equalized to the first predetermined current.

6. The reference voltage generating circuit of claim 5, wherein the current mirror circuit comprises a second transistor having a base and a collector connected to each other, and a third transistor having a base connected to the base of the third transistor, the second predetermined current being supplied to the collector of the second transistor in such a way that a current ratio (I2/IS2)/(I3/IS3) of the second and third transistors is set to a roughly constant value, where I2 is a collector current of the second transistor; I3 is a collector current of the third transistor; IS2 is a saturated emitter current of the second transistor; IS3 is a saturated emitter current of the third transistor.

7. A compactor circuit, comprising:

an operational amplifier having a first input terminal, a second input terminal, and an output terminal for outputting a reference signal having a reference voltage;

voltage supplying means having at least one transistor, for supplying a voltage independent of a current amplification factor of the transistor to the first input terminal of the operational amplifier via the transistor;

a resistor connected between the second input terminal and the output terminal of the operational amplifier;

current supplying means for supplying a predetermined current independent of the reference voltage to the second input terminal of the operational amplifier via the resistor; and a comparator for comparing an input signal with the reference signal in voltage level to output an output signal corresponding to a comparison result between the input signal and the reference signal.

8. A method of generating a reference voltage by use of a circuit having an operational amplifier, a transistor having a base and a collector both connected to a first input terminal of the operation amplifier and an emitter connected to ground, and a resistor connected between a second input terminal and an output terminal of the operational amplifier, the method comprising the steps of:

supplying a voltage independent of a current amplification factor of the transistor to the first input terminal of the operational amplifier via the transistor; and supplying a first predetermined current independent of the reference voltage to the second input terminal of the operational amplifier via the resistor.

9. The method of generating a reference voltage of claim 8, wherein the current supplying step comprises the step of supplying a current proportional to the current amplification factor of the first transistor to the base and the collector of the first transistor.

10. The method of generating a reference voltage of claim 8, wherein the current supplying step further comprises the steps of:

connecting a current mirror circuit to the second input terminal of the operational amplifier; and supplying a second predetermined current to the current mirror circuit, to activate the current mirror circuit in such a way that current supplied to the second input terminal of the operational amplifier via the resistor is equalized to the first predetermined current.

11. The method of generating a reference voltage of claim 10, wherein the second predetermined current supplying step comprises the step of supplying the second predetermined current to the current mirror circuit having a first transistor having a base and a collector connected in common and a second transistor having a base connected to the base of the first transistor, in such a way that the second predetermined current is supplied to the collector of the first transistor so that a current ratio (I1/IS1)/(I2/IS2) of the first and the second transistors is set to a roughly constant value, where I1 is a collector current of the first transistor; I3 is a collector current of the second transistor; IS1 is a saturated emitter current of the first transistor; and IS2 is a saturated emitter current of the second transistor.

* * * * *